United States Patent [19]

Weidman et al.

[11] Patent Number: 5,061,911

[45] Date of Patent: Oct. 29, 1991

[54] SINGLE FAULT/TOLERANT MMIC SWITCHES

[75] Inventors: John H. Weidman; Glenn Yoshiyama, both of Chandler, Ariz.

[73] Assignee: Motorola, Inc., Schaumburg, Ill.

[21] Appl. No.: 503,597

[22] Filed: Apr. 3, 1990

[51] Int. Cl.[5] ..... H01P 1/15

[52] U.S. Cl. ..... 333/104; 333/262

[58] Field of Search ..... 333/103, 104, 262; 307/219, 571, 584

[56] References Cited

U.S. PATENT DOCUMENTS 4,308,467 12/1981 Kolluri et al. ..... 307/571 X 4,897,563 1/1990 Bahl ..... 333/103 X

*Primary Examiner*—Paul Gensler

*Attorney, Agent, or Firm*—Frank J. Bogacz

[57] ABSTRACT

A single fault/tolerant monolithic microwave integrated circuit field effect transistor switching arrangement. This circuitry provides for the high speed (up to 18 GHz) switching of RF input signals while maintaining a circuit which is single fault/tolerant. That is, a single FET within the circuit may become faulty and the operation of the switching arrangement remains unaltered. The circuitry also provides for a self-terminating feature inherent in this FET switch.

13 Claims, 3 Drawing Sheets

-PRIOR ART-

-PRIOR ART-

-PRIOR ART-

-PRIOR ART-

SINGLE FAULT/TOLERANT MMIC SWITCHES

STATEMENT OF GOVERNMENT INTEREST

This invention was made with Government support under Contract No. 87-C-5727. The Government has certain rights in this invention.

BACKGROUND OF THE INVENTION

The present invention pertains to monolithic microwave integrated circuit (MMIC) switches and more particularly to single fault/tolerant MMIC switches employing gallium arsenide field effect transistors (FETs) as switching elements.

Electronic systems which are put into space or placed in remotely located conditions are difficult to maintain. Due to the complexity and interdependence of such systems on various subsystems, a single electronic component failure may cause a system to malfunction and therefore be unserviceable.

Therefore, systems in space or remotely located places require high reliability in order to maintain a functional system. One solution to this problem is to provide additional circuitry for the detection of a failure. This additional circuitry detects a failure and enables a backup or secondary unit to become operational in place of the original unit. Such circuits do provide higher reliability than a single circuit, however, an additional cost is incurred for the circuitry to detect the failure and to perform a switchover between the original and backup units.

Electronic systems regular utilize field effect transistors (FETs). These field effect transistors operate as switches within the electronic system. These FET switches are subject to failure as are other components of an electronic system. Applying the above-mentioned arrangement of detecting the failure of a FET and enabling a secondary FET to functionally perform in place of the original FET is a cumbersome and expensive system.

A FET is an active component. A failure of an active component in an electronic system may cause a catastrophic failure.

Accordingly, it is an object of the present invention to provide for an autonomous, single fault/tolerant MMIC switch utilizing gallium arsenide field effect transistors.

SUMMARY OF THE INVENTION

In accomplishing the above of the present invention, a novel, single fault/tolerant MMIC switch utilizing gallium arsenide FETs is shown.

A single fault/tolerant monolithic microwave integrated circuit (MMIC) for switching an RF input signal includes a plurality of field effect transistors. Each of the field effect transistors has a gate input, a source input and a drain output. The gate inputs of two FETs are connected in common and operate to control switching of the FET. The source inputs of the two FETs are also connected in common and are adapted to receive the RF input signal. The drain outputs of the two FETs are also connected in common. The drain outputs operate in response to the RF signal input and to a logic level applied to the gate input of each FET. As a result, the FETs produce an RF signal output equivalent to the input and maintain single fault operation for switching the RF input signal.

The above and other objects, features, and advantages of the present invention will be better understood from the following detailed description taken in conjunction with the accompanying drawings.

DESCRIPTION OF THE PREFERRED EMBODIMENT

Referring to FIGS. 1A through 1D, the basic inventive concepts of this application are shown. The invention includes microwave switches which are developed by employing gallium arsenide FETs as the switching elements. The present invention includes a novel topology of gallium arsenide FETs in a switching configuration that yields a single fault/tolerant switch. FIG. IA depicts an unterminated prior art FET switch 1. The RF input is connected to a finite length transmission line 2 of a particular impedance. This transmission line 2 may include a microstrip track on a chip. The output of transmission line 2 is connected to the source input of FET 1. As can clearly be seen, any single point failure within FET 1 will render FET 1 inoperable. Therefore, the switching action of FET 1 does not occur.

Figure 1A:
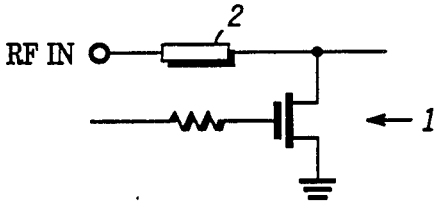
FIGS. 1A, 1B, 1C and 1D are schematic diagrams of MMIC switching elements.
Figure 1B:
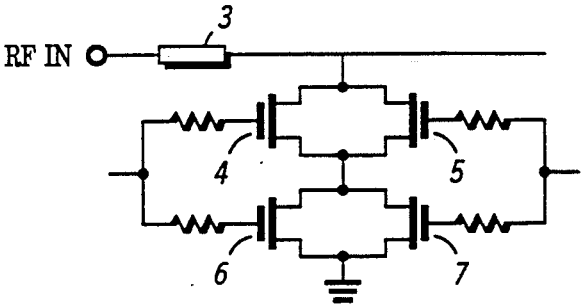

Referring to FIG. 1B, the basic concepts of the Applicants' invention are shown.

The RF input is connected through transmission line 3. Transmission line 3 is similar to transmission 2 of the prior art. However, the output of transmission line 3 is connected to a series-shunt combination of four FETs as shown in FIG. lB. The combination of FETs 4 and 5 is a shunt connection. The shunt connection of FETs 4 and 5 is connected in series with the shunt connection of FETs 6 and 7. As can be seen, a single fault in any of the FETs 4 through 7, will not result in an outage of the switch of FIG. 1B. That is, should FET 4 fail, FET 5 handles the switching operation. Similarly if FET 7 fails, FET 6 will perform the switching operation.

The switches of FIG. 1 are implemented utilizing monolithic microwave integrated circuit (MMIC) technology. Gallium arsenide is employed as the semiconductor media. The use of MMIC technology allows operation of the FET switches into the upper microwave frequencies (approximately 18 GHz) due to the minimization of unwanted parasitics and an extremely small size.

For a shorted condition of FET 4, the input signals pass through FET 4 and the switching operation performed by FETs 6 and 7. Similarly for a short in FET 6 or 7 which would render the other FET non-operative, FETs 4 and 5 perform the switching operation.

Figure 1C:
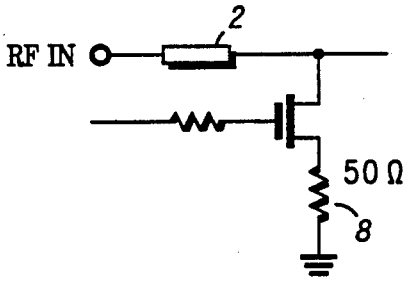
Figure 1D:
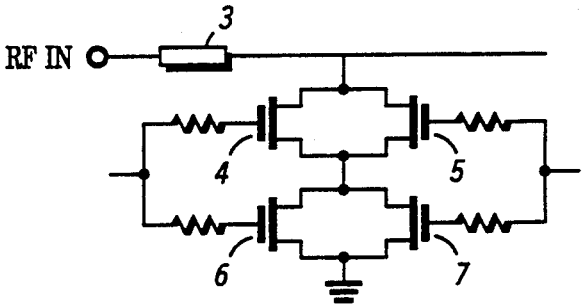

Referring to FIGS. 1C and 1D, a MMIC switch termination of the prior art is shown in FIG. 1C and the present invention to replace the prior art is shown in FIG. 1D. FIG. 1C is similar to FIG. 1A as described above except that resistor 8 is included connected between the source and ground. Resistor 8 is a 50 ohm resistor providing for termination of the switch.

FIG. 1D shows an MMIC switch self-terminating switch according to the Applicants' invention. It is to be noted that this switch termination of FIG. 1D is identical to that of FIG. 1B. First, the MMIC self-terminating switch of FIG. 1D provides for single fault/tolerant switching operation as was explained above for FIG. 1B. The self-termination feature derives from the fact that FETs 4-7 are chosen to have an on-resistance of 50 ohms. Second, the MMIC switch termination of FIG. 1D provides for an identical switching unit for termination or switching stages prior to termination. As a result, the manufacturing and design of elaborate FET switches is made more simple.

The switching design of the FET depends upon its two operating states. The first state is the high impedance or off state and the second state is the low impedance or on state. These states are determined between the drain and source terminals of the FET and are dependent upon the gate/source voltage being applied. The selection of the FET sizes employed for the switching operation greatly affects the high frequency operation, insertion loss and isolation of the switch.

Figure 2A:
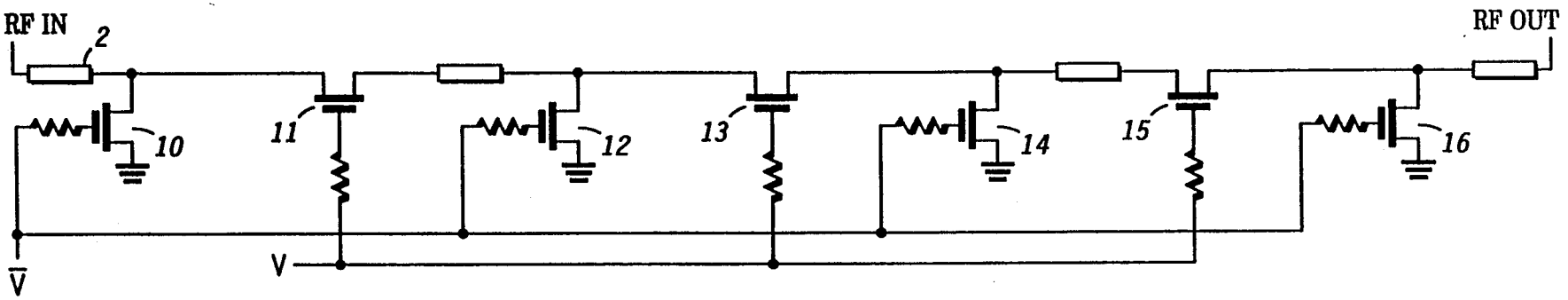
FIGS. 2A and 2B are schematic diagrams of single-pole, single-throw MMIC FET switching configurations.
Figure 2B:
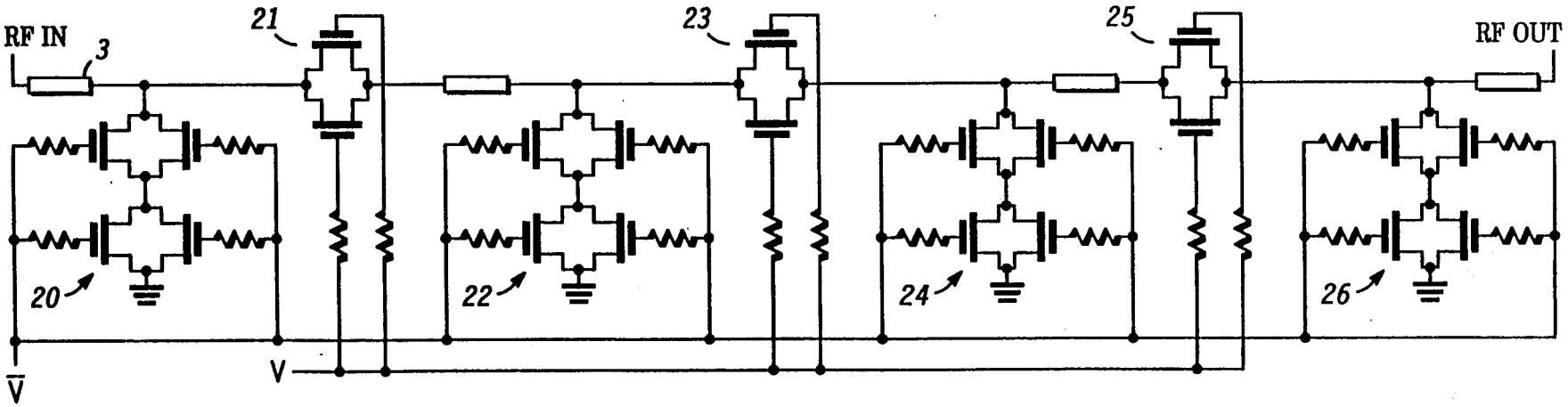

Referring to FIGS. 2A and 2B, an application of the Applicants' invention discussed in FIG. 1 is shown. FIG. 2A is a prior art configuration of a single-pole, single-throw FET switch. FETs 10, 12, 14 and 16 are shorting FETs. That is, each of these FETs (10, 12, 14 and 16) when the voltage $\bar{v}$ is applied, will short circuit to ground any RF signal input. Similarly FETs 11, 13 and 15 are conducting FETs. When an input on the V lead is true, FETs 11, 13 and 15 will be switched on and FETs 10, 12, 14 and 16 will be high impedance. Therefore, the RF signal input will be transmitted through the various FET switching stages and appear at the RF OUT terminal. By manipulating the V and $\bar{v}$ control leads, an input signal to the RF IN terminal will either be transmitted out through the RF OUT terminal or short circuited to ground (no output).

A transmission switching circuit such as shown in FIG. 2A is a distributed element transmission line. The FETs may be implemented on gallium arsenide semiconductor material. Each of the transmission lines, such as transmission line 2, may be implemented via a microstrip track on the semiconductor chip along with the FETs.

Referring to FIG. 2B, the Applicants' invention has been applied to the single-pole, single-throw FET MMIC switch of FIG. 2A. Each of the conducting FET arrangements 21, 23 and 25 of FIG. 2B are serially connected between the RF IN terminal and the RF OUT terminal. Also, serially connected alternating between each of the conducting FET MMIC switches are transmission lines which may be implemented on a microstrip track. Each of the components including the transmission lines may be implemented on a single gallium arsenide chip. The gate inputs of FET switches 21, 23 and 25 are each connected to the V input lead. The V input lead is a control lead and when a logic 1 is applied via the V lead, the respective switches 21, 23 and 25 are turned on. Then the input signal at the RF IN terminal is transmitted out from the RF OUT terminal.

The gate input of each of the FETs of switches 21, 23 and 25 are connected together. Also, the drains and sources of the FETs of switches 21, 23 and 25 are respectively connected. Therefore, if one of the FETs of any of the switches 21, 23 or 25 fails the other switch of the combination will provide for transmitting the input signal applied at the RF IN terminal through to the output at the RF OUT terminal. Therefore, each of the switches 21, 23 and 25 is single fault/tolerant. That is, a single fault will not render the single-pole, single-throw FET MMIC switch inoperable.

With respect to shorting switches 20, 22, 24 and 26, they are single fault/tolerant MMIC FET switches as shown in FIGS. 1B and 1D. Since switch 26 is the last one in the series of switches, it is referred to as a termination switch. Previously, as seen from the prior art configurations of FIGS. 1A and 1C, termination switches were different than the basic FET switches. That is the termination switches had an extra 50 ohm resistor to terminate the connection. It is to be noted, however, that in FIG. 2B each of the switches 20, 22, 24 and 26 are of the same configuration and are self-terminating. Therefore, the advantage obtains that only one FET MMIC switch is required for a shorting switch. This makes for simpler design and fewer manufacturing as well as design operations.

The gates of FET switches 20, 22, 24 and 26 are each connected to the $\bar{v}$ input. The $\bar{v}$ input is a control lead and is the opposite binary value from the V input. The sources and drains of each FET of a particular switch are connected to each other. That is, the sources and drains of the two sets of two FETs each have their sources and drains connected. The first pair of FETs of each switch is serially connected from the drain to the source of the next set of FETs. The drain of the next set of FETs is connected to ground. As previously explained, any failure of a single FET will not cause an inoperable state of the MMIC FET single-pole, single-throw switch.

As can be seen, when the V signal is applied, each of the FETs which is 21, 23 and 25 conduct the input signal applied at the RF IN terminal through to the output at the RF OUT terminal. While at the same time, the $\bar{v}$ signal is at a logic 0, each of the FETs is 20, 22, 24 and 26 are inoperative and appear as a high impedance to the RF signal.

In contrast, when the $\bar{v}$ signal is at logic 1, each of the FET MMIC switches 20, 22, 24 and 26 are turned on and conduct the RF input signal to ground. Since the $\bar{v}$ signal is at logic 1, the V signal is at logic 0 and each of the FET switches 21, 23 and 25 are off and appear as a high impedance to the input signal.

In the above single-pole, single-throw switch example, switches of three and four elements have been shown. However, the switches are not limited to three or four-element switches. Greater amounts of shorting and conducting FET switches may be used. However, the insertion loss of larger strings of FETs switches is increased as the number of FET switches increases. The isolation increases as the number of FET switches increases. So therefore, there is a tradeoff between the isolation obtained by circuit and the insertion loss.

Figure 3A:
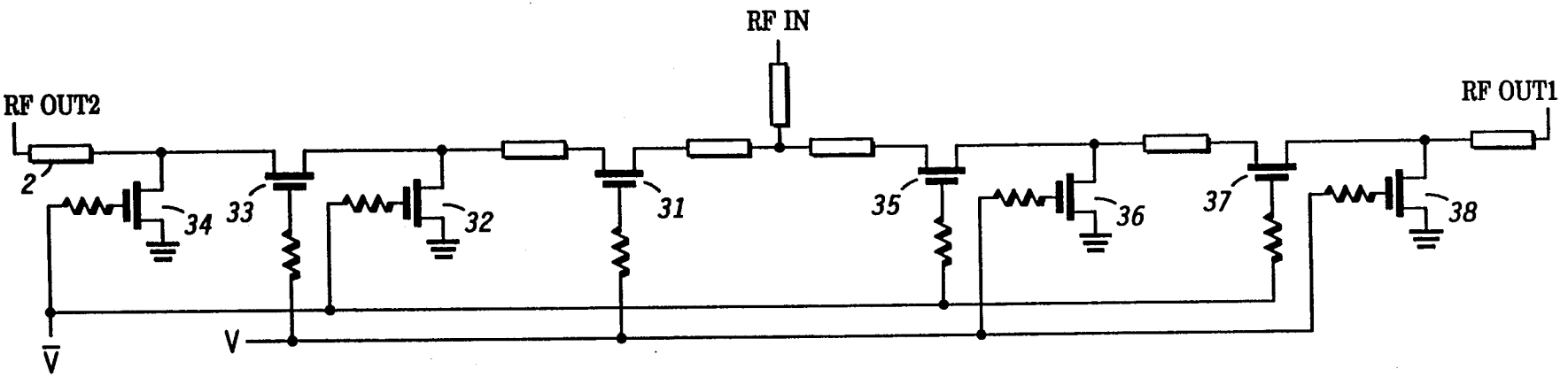
FIGS. 3A and 3B are schematic diagrams of single-pole, double-throw FET switching configurations.

FIG. 3A depicts a prior art schematic of a single-pole, double-throw FET MMIC switch. The input signal is applied at the RF IN terminal and is divided to flow toward FET 31 as well as FET 35. Basically the switch operates to provide the RF output signal at either the RF OUT 1 or RF OUT 2 terminals. Conducting FETs of the RF OUT 1 side have their gate input connected to the $\bar{v}$ lead. The conducting FETs 31 and 33 of the RF OUT 2 side have their gate inputs connected to the V lead. Therefore, when the V and $\bar{v}$ signals are applied, only one output will appear at the RF OUT 1 or RF OUT 2 terminals. When the $\bar{v}$ lead is at logic 1, FETs 35 and 37 will conduct and the output applied at the RF IN terminal will appear at the RF OUT 1 terminal. Conversely, when V is at logic 1 and $\bar{v}$ is at logic 0, conducting FETs 31 and 33 will operate and the signal at the RF IN terminal will appear at the RF OUT 2 terminal and no signal will appear at the RF OUT 1 terminal.

Figure 3B:
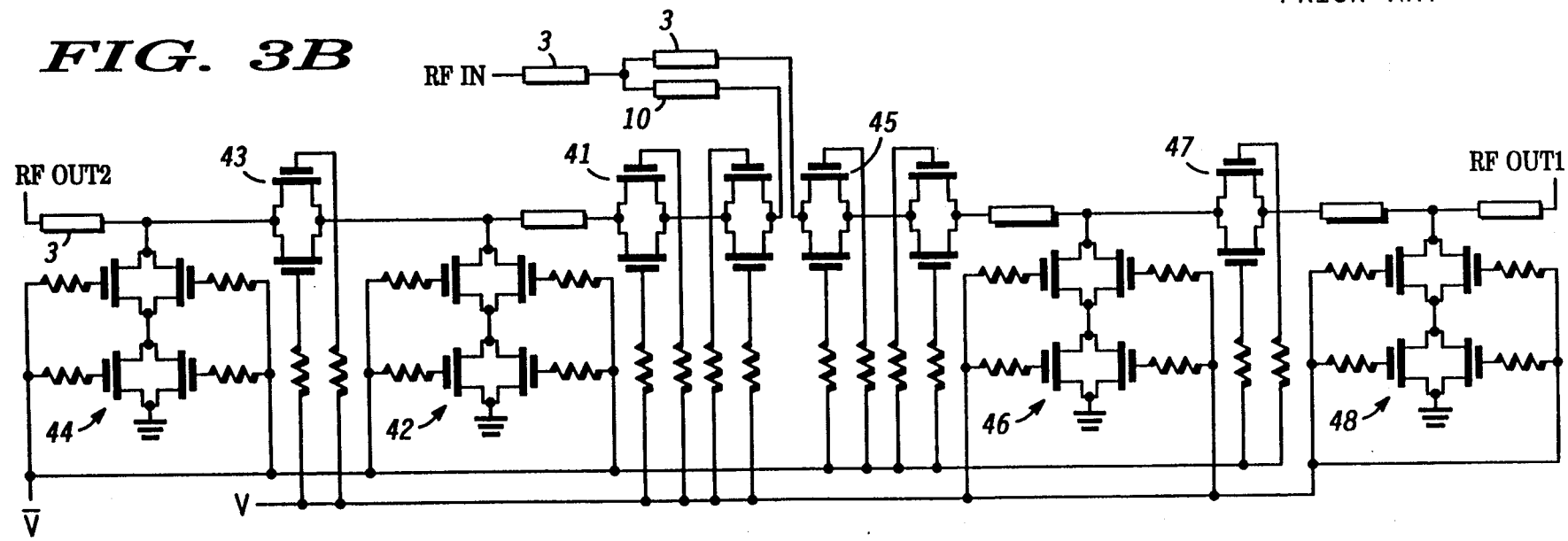

Referring to FIG. 3B, the Applicants, invention, as previously explained, has been applied to the prior art shown in FIG. 3A. The RF IN terminal which transmits the RF input signal is shown connected to both FETs which is 41 and 45. Serially connected to FET switch 41 is FET switch 43 and the output RF OUT 2 is serially connected to FET switch 43. Similarly, RF IN terminal is connected to FET switch 45. FET switch 45 is serially connected to FET switch 47 which is serially connected to output terminal RF OUT 1.

The gates of FETs 41 and 43 are connected to the V lead. In contrast, the gates of FETs 45 and 47 are connected to the $\bar{v}$ lead. Shorting FETs 42, 44, 46 and 48 are connected between the RF IN lead and ground. Shorting FETs 42 and 44 have the gate inputs connected to the $\bar{v}$ lead. In contrast, shorting FETs 46 and 48 have their gate inputs connected to the V lead.

When the V signal is at logic 1, FETs 41 and 43 are operated and conduct the RF signal to the RF OUT 2 terminal. FETs 42 and 44 at this time, since the $\bar{v}$ signal is at logic 0, are inoperative and present a high impedance. In contrast, since the $\bar{v}$ signal is at logic 0, FETs 45 and 47 are high impedance. Since V is at logic 1, FETs 46 and 48 are operated and place a ground potential on the RF IN lead which is connected to the RF OUT 1 terminal. As a result, the input signal applied at the RF IN terminal is output at the RF OUT 2 terminal and no output exists at the RF OUT 1 terminal.

When the control signals V and $\bar{v}$ change states, V is at logic 0 and $\bar{v}$ is at logic 1, the input signal from the RF IN terminal appears at the RF OUT 1 terminal and no output appears at the RF OUT 2 terminal. With the control leads V and $\bar{v}$ in this condition, FETs 45 and 47 conduct while FETs 46 and 48 are at high impedance. At the same time, FETs 41 and 43 are at high impedance and FETs 42 and 44 conduct. As a result, the output signal is blocked from proceeding to the RF OUT 2 terminal and ground is effectively placed at this terminal. As can be seen, a single fault in any of the FET switches 41 through 48 will not impair the operation of the single-pole, double-throw FET MMIC switch shown in FIG. 3B. As a result, a single fault/tolerant, single-pole, double-throw switch for various applications has been shown.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. A single fault/tolerant monolithic microwave integrated circuit (MMIC) for switching an RF input signal, said fault/tolerant MMIC comprising:

a plurality of field effect transistors (FETs) including at least first, second, third and fourth FETs, each said FETs having a gate input, a source input and a drain output;

said gate inputs of said first and second FETs being coupled together and said gate inputs operating in response to a source of a first logic level to control switching of said FET;

said source inputs of said first and second FETs being connected together and adapted to receive said RF input signal; ;

said drain outputs of said first and second FETs being connected together, said drain outputs of said first and second FETs each operating in response to a first logic level applied to said gate input to transmit said RF input signal whereby for a single fault of said first FET said signal FET remains operational to switch said RF input signal;

said gate inputs of said third and fourth FETs being connected to said gate inputs of said first and second FETs;

each of said first, second, third and fourth FETs include a FET having an on-resistance of approximately 50 ohms.

2. A single fault/tolerant MMIC as claimed in claim 1, wherein said gate inputs are connected to a source of a second logic level and said drain outputs of said first and second FETs provide a high impedance to said RF input signal.

3. A single fault/tolerant MMIC as claimed in claim 1, wherein said plurality of said FETs further includes:

said source inputs of said third and fourth FETs being connected in common, said drain outputs of said first and second FETs being connected to said common connection of said source inputs of said third and fourth FETs; and said drain outputs of said third and fourth FETs being connected in common to a source of electronic ground.

4. A single fault/tolerant MMIC as claimed in claim 3, wherein said first, second, third and fourth FETs are fabricated on gallium arsenide semiconductor material.

5. A single fault/tolerant MMIC as claimed in claim 4, wherein said first, second, third and fourth gallium arsenide FETs transmit a signal in the frequency range up to 18 GHz.

6. A single fault/tolerant, single-pole, single-throw monolithic microwave integrated circuit (MMIC) field effect transistor (FET) switch comprising:

an RF source for providing an input RF signal;

first and second control leads for supplying first and second control signals respectively;

first single fault/tolerant FET means connected to said RF source, to said first control lead and to electronic ground, said first single fault/tolerant FET means operating in response to a first logic level of said first control lead to short circuit said input RF signal to the electronic ground, said first single fault/tolerant FET means operating in response to a second logic level of said first control lead to transmit said RF input signal;

second single fault/tolerant FET means connected to said first single fault/tolerant FET means, to said second control lead and to an RF output, said second single fault/tolerant FET means operating in response to said first logic level of said second control lead to transmit said input RF signal on said RF output lead, said second single fault/tolerant FET means alternately operating in response to said second logic level of said second control lead to inhibit transmission of said RF input signal on said RF output;

said first single fault/tolerant FET means including a plurality of first single fault/tolerant FETs having an on-resistance of approximately 50 ohms;

said second single fault/tolerant FET means including a plurality of second single fault/tolerant FETs having an on-resistance of approximately 50 ohms; and said first and said second single fault/tolerant FETs being alternately connected between said RF source and said RF output, so that there are N first single fault/tolerant FET means alternately serially connected with N−1 of said second single fault-/tolerant FET means.

7. A single fault/tolerant, single-pole, single-throw MMIC FET switch as claimed in claim 6, wherein each of said first single fault/tolerant FETs includes:

a plurality of FETs including at least a first, second, third and fourth FET, each said FET having a gate input, a source input and a drain output;

said gate input of said first and second FETs being connected together and said gate inputs operating in response to a first logic level of said first control lead to control switching of said first and second FETs;

said gate inputs of said third and fourth FETs being connected together and said gate inputs operating in response to a first logic level of said first control lead to control switching of said third and fourth FETs;

said source inputs of said first and second FETs being connected and adapted to receive said input RF signal;

said drain outputs of said first and second FETs being connected together;

said source inputs of said third and fourth FETs being connected in common and connected to said drain outputs of said first and second FETs; and said drain outputs of said third and fourth FETs being connected in common and to a source of electronic ground, said drain outputs of said third and fourth FETs connecting said input RF input signal to electronic ground in response to a first logic level of said first control lead.

8. A single fault/tolerant, single-pole, single-throw MMIC FET switch as claimed in claim 6, wherein each of said second single fault/tolerant FETs includes:

a plurality of FETs including at least a first and second FET each said FET having a gate input, a source input and a drain output;

said gate inputs of said first and second FETs being connected in common and connected to a first control lead, said gate inputs operating to control switching of said first and second FETs respectively;

said source inputs of said first and second FETs being connected in common and adapted to receive said input RF signal; and said drain outputs of said first and second FETs being connected in common, said drain outputs of said first and second FETs each operating in response to a first logic level of said second control lead to transmit said RF input signal whereby for a single fault of said first FET, said second FET remains operational to switch RF input signal.

9. A single fault/tolerant, single-pole, double-throw MMIC FET switch comprising:

an RF source of an RF input signal;

first and second control leads for providing first and second control signals respectively;

first and second RF outputs, one of said first and second outputs selectively transmitting said RF input signal;

first single fault/tolerant FET switching means connected to said RF source, to said second RF output and to said first and second control leads, said first single fault/tolerant FET switching means operating in response to a first logic level of said second control lead and a second logic level of said first control lead to provide said RF input signal at said second RF output;

second single fault/tolerant FET switching means connected to said RF source, said first RF output and to said first and second control leads, said second single fault/tolerant FET switching means operating in response to a first logic level of said first control lead and a second logic level of said second control lead to provide said RF input signal at said first RF output; and said first single fault/tolerant FET switching means including first and second pluralities of first single fault/tolerant FETs, each having an on-resistance of approximately 50 ohms; and said second single fault/tolerant FET switching means including first and second pluralities of second single fault/tolerant FETs, each having an on-resistance of approximately 50 ohms;

said first plurality of first single fault/tolerant FETs including;

first FET switching means connected to said RF source and to said second control lead;

said second plurality of first single fault/tolerant FETs including;

second FET switching means connected to said first FET switching means, to said first control lead and to the electronic ground; and said first plurality of first single fault/tolerant FETs further including;

third FET switching means connected to said first and second FET switching means, to said second RF output and to said second control lead.

10. A single-pole double-throw MMIC FET switch as claimed in claim 9 said first plurality of second single fault/tolerant FETs including:

fourth FET switching means connected to said RF source and to said first control lead;

said second plurality of second single fault/tolerant FETs including;

fifth FET switching means connected to said fourth FET switching means, to the electronic ground and to said second control lead; and said first plurality of second single fault/tolerant FETs further including;

sixth FET switching means connected to said fourth and fifth FET switching means, to said first RF output and to said first control lead.

11. A single-pole, double-throw MMIC FET switch as claimed in claim 10, wherein said third and sixth FET switching means each includes:

a plurality of FETs including at least a first and a second FET, each said FET having a gate input, a source input and drain output;

said gate inputs of said first and second FETs being connected together and said gate inputs operating to control switching of said first and second FETs;

said source input of said first and second FETs being connected together and adapted to receive said RF input signal; and said drain outputs of said first and second FETs being connected together said drain outputs of said first and second FETs each operating in response to said first logic level of said first control lead to transmit said RF input signal whereby for a single fault of said first FET, said second FET remains operational to switch said RF input signal.

12. A single-pole, double-throw MMIC FET switch as claimed in claim 10 said first and fourth FETs switching means including:

a plurality of FETs including at least a first, second, third and fourth FET, each said FET having a gate input, a source input and a drain output;

said gate input of said first and second FETs being connected together and said gate inputs operating to control switching of said first and second FETs;

said gate inputs of said third and fourth FETs being connected together and said gate inputs operating to control switching of said third and fourth FETs;

said source inputs of said first and second FETs being connected together and adapted to receive said RF input signal;

said drain outputs of said first and second FETs being connected together;

said source inputs of said third and fourth FETs being connected in common and connected to said drain outputs of said first and second FETs; and said drain outputs of said third and fourth FETs being connected in common, said drain outputs of said third and fourth FETs transmitting said RF input signal in response to a first logic level of said first and second control leads.

13. A single-pole, double-throw MMIC FET switch as claimed in claim 10, wherein said second and fifth FET switching means including:

a plurality of FETs including at least a first, second, third and fourth FET, each said FET having a gate input, a source input and a drain output;

said gate input of said first and second FETs being connected together and said gate inputs operating to control switching of said first and second FETs;

said gate inputs of said third and fourth FETs being connected together and said gate inputs operating to control switching of said third and fourth FETs;

said source inputs of said first and second FETs being connected together and adapted to receive said RF input signal;

said drain outputs of said first and second FETs being connected together;

said source inputs of said third and fourth FETs being connected in common and connected to said drain outputs of said first and second FETs;

said drain outputs of said third and fourth FETs of said second FET switching means being connected in common and to a source of electronic ground, said drain outputs of said third and fourth FETs of said second FET switching means for connecting said RF input signal to electronic ground in response to a first logic level of said first control lead; and said drain outputs of said third and fourth FETs of said fifth FET switching means being connected in common and to a source of electronic ground, said drain outputs of said third and fourth FETs of said fifth FET switching means for connecting said RF input signal to electronic ground in response to a first logic level of said second control lead.

* * * * *